United States Patent [19]

Fujimoto et al.

[11] Patent Number: 4,542,783

[45] Date of Patent: Sep. 24, 1985

[54] REFRIGERATION EQUIPMENT

[75] Inventors: Yuji Fujimoto, Osaka; Masayuki Aono, Sakai; Tetuo Nakano, Takaishi; Teiji Nakabayashi, Kishiwada, all of Japan

[73] Assignee: Daikin Industries, Ltd., Osaka, Japan

[21] Appl. No.: 530,128

[22] Filed: Sep. 7, 1983

[30] Foreign Application Priority Data

Dec. 28, 1982 [JP] Japan ..... 57-234267

[51] Int. Cl.[4] ..... F25B 29/00

[52] U.S. Cl. ..... 165/30; 62/196.4; 236/92 B

[58] Field of Search ..... 62/196.4, 210, 278, 62/197; 165/30; 236/92 B

[56] References Cited

U.S. PATENT DOCUMENTS

| | | | |
|---|---|---|---|
| 3,734,810 | 5/1973 | Davis | 62/196.4 |
| 3,791,160 | 2/1974 | Savitz et al. | 62/196.4 |
| 3,933,004 | 1/1976 | Carter et al. | 62/196.4 |
| 4,095,742 | 6/1978 | Schumacher | 236/92 B |
| 4,240,266 | 12/1980 | Scrine et al. . | |

FOREIGN PATENT DOCUMENTS

| | | |
|---|---|---|
| 49375 | 11/1972 | Australia . |
| 45659 | 2/1982 | European Pat. Off. . |
| 2224462 | 1/1973 | Fed. Rep. of Germany . |
| 2950264 | 7/1980 | Fed. Rep. of Germany . |

*Primary Examiner*—William E. Wayner

*Attorney, Agent, or Firm*—Stevens, Davis, Miller & Mosher

[57] ABSTRACT

A refrigeration equipment having a compressor, a condenser, an evaporator and a thermostatic expansion valve with an equalizer line and capable of controlling its refrigeration capacity, wherein incorporated are a hot gas by-pass passage and a hot gas valve installed thereon to introduce the hot gas into said evaporator by by-passing said condensor and thermostatic expansion valve, a control passage to introduce, during the hot gas by-pass operation, a portion of hot gas to said equalizer line and throttle the opening of said expansion valve and a communication shut-off valve to shut off, at the close of said hot gas valve, the communication between said control passage and equalizer line, whereby controlling the opening of said expansion valve in accordance with hot gas by-passed during the capacity control by use of hot gas, so that the control range of said refrigeration capacity can be extended.

10 Claims, 10 Drawing Figures

REFRIGERATION EQUIPMENT

FIELD OF THE INVENTION

This invention relates to a refrigeration equipment, or more particularly, to a mobile refrigeration equipment for use with land or marine containers that is so constructed as to control the temperature of the space to be controlled over a wide temperature range covering both the domain of low temperature below −5° C. or −6° C. (hereinafter called as "refrigeration domain") and that of high temperature above −5° C. or −6° C. (hereinafter called as "chilled domain").

BACKGROUND OF THE INVENTION

Generally, a refrigeration equipment with a wide range of temperature control is used primarily with the containers that are subject, in operation, to a wide range of temperature fluctuations of ambient air. Namely, the refrigeration equipment for container use so far known is so constructed as to usually perform two modes of operations, that is, refrigeration operation to control the hold temperature of container at a low temperature below −5° C. or −6° C. of refrigeration domain and cold storage operation to control said temperature at a high temperature above −5° C. or −6° C. of chilled domain. To this end, the capacity of the container refrigeration equipment is set at the capacity requirement of refrigeration operation, that is, at the capacity sufficient to keep the hold temperature, for example, at −18° C. under the ambient air temperature of 38° C.

Therefore, in case of cold storage operation to maintain the hold temperature within chilled domain, there arises an excess capacity under the condition of low ambient air temperature, resulting in a problem of being unable to maintain the desired hold temperature.

In order to solve said problem, it has been suggested to control the hold temperature by installing a hot gas by-pass passage, bridging between high pressure gas line and low pressure liquid line and introducing hot gas to the evaporator therethrough.

While the refrigeration equipment of the conventional method is also shown in the description and drawings of U.S. Pat. No. 3,692,100, it is so constructed, as shown in FIG. 10, as to install, on the high pressure gas line connecting the discharge side of a compressor A with the inlet side of an air-cooled condensor $C_1$, a hot gas by-pass passage by-passing said condenser $C_1$, water-cooled condenser $C_2$, drier R and expansion valve EV, all in-series connected, a solenoid valve SV and a temperature control valve TV with a sensor T, on said hot gas by-pass passage, thus it is able to control the hold temperature within chilled domain through the temperature control of supply air under hot gas by-pass operation.

Namely, in case of cold storage operation, said solenoid valve SV is open and said temperature control valve TV opened when supply air temperature is below the temperature setting, thus hot gas being fed into said low pressure liquid line D and after being mixed with liquid rerigerant fed through expansion valve EV, introduced into evaporator E. Thus it is arranged so as to control the hold temperature within chilled domain by adjusting the supply air temperature.

When the hold temperature setting is low or, even though said temperature setting is high, when ambient air temperature is higher than said temperature setting, that is, in the hatched area M of FIG. 9, it is possible with the refrigeration equipment of the conventional method to control the hold air temperature by hot gas by-pass method. However, when the temperature setting is high and the ambient air temperature is lower, that is, in the unhatched area N of FIG. 9, there arises a problem of being unable to control the hold air temperature by means of hot gas by-pass because in said area N, the heating effect decreases with the increase of refrigeration capacity.

Furthermore, said expansion valve EV is generally of the type of the thermostatic expansion valve wherein the opening is controlled by sensing the temperature of low pressure gas and as stated above, in case of the hold temperature control by means of hot gas by-pass, low pressure gas at the out-let of evaporator E becomes superheated by hot gas by-passed, the opening of said expansion valve EV with a feeler bulb attached to low pressure gas line G being increased further. As a result, even when ambient air temperature becomes lower, the liquid refrigerant flow through said expansion valve EV is increased because of the valve opening that is equal to or larger than that of the case of high ambient air temperature.

Therefore, under said condition, even if means of hot gas by-pass is employed, it is impossible to control the hold temperature because heating effect thereof is overcome by cooling effect of liquid refrigerant. Further, with the increase of valve opening of said expansion valve EV, the power in-put of compressor will also increase, thus resulting in the waste of energy and failure to meet the requirement of energy saving.

SUMMARY OF THE INVENTION

The purpose of this invention is to control, while performing the supply air temperature control by means of hot gas by-pass, the opening of the expansion valve installed on the liquid line by using the pressure of hot gas by-passed, thus reducing the liquid refrigerant flow through said expansion valve and to broaden the control range of the hold temperature as wide as possible and at the same time to reduce the energy in-put to compressor at a low load operation, thus meeting the requirement of energy saving.

This invention provides, in a refrigeration equipment having a compressor, a condenser, an evaporator with its equalizer line connected to a low pressure line that connects compressor suction and expansion valve outlet, a means of controlling the refrigeration capacity that incorporates (1) a hot gas by-pass passage whereby hot gas discharge from said compressor is introduced to said evaporator by by-passing said condenser and expansion valve, (2) a hot gas valve installed on said hot gas by-pass passage and controlling hot gas to be introduced to said evaporator, (3) a control passage connected on the secondary side of said hot gas bypass passage and introducing a portion of hot gas into said equalizer line to control the opening of said expansion valve by hot gas pressure and (4) a communication shut-off valve that shut off, at the close of said hot gas valve, the communication between said hot gas by-pass passage and said equalizer line. By this control means, it is possible to reduce the opening of said expansion valve by throttling when hot gas is employed to reduce the refrigeration capacity, thus reducing the refrigerant flow through said expansion valve and consequently the refrigeration capacity and broaden the control range of supply air temperature when the loading is low, thus contributing to the minimization of compressor in-put.

Namely, the feature of this invention is not only to provide the capacity control by hot gas by-pass to evaporator but also to improve the accuracy of the capacity control by controlling the opening of the expansion valve by use of said hot gas by-passed and to enable the refrigeration equipment to control its refrigeration capacity even at a low loading, for example, when the temperature setting is high or when the ambient air temperature is lower than the temperature setting, extending the control range to the unhatched area N of FIG. 9. Thus even at an extremely low ambient temperature and at a temperature setting higher than this ambient temperature, the capacity control is possible, the operation range being extended that much.

Furthermore, because it is possible to reduce the opening of said expansion valve during the capacity control by hot gas by-passed, the refrigerant flow circulated in the refrigeration circuit is reduced, thus resulting in the elimination of the wasted energy.

In this connection, the hot gas valve and the communication shut-off valve of said means of control are of the type of the solenoid valve, actuating on electricity and controlled by a controller. Said controller incorporates a temperature sensor to sense at least either of the return air temperature to said evaporator or the supply air temperature from said evaporator, a setting input unit for in-put of the temperature setting, and a central processing unit that compares the temperature of at least either of the return air or supply air with the temperature setting and out-puts the control signal whereby the control of said hot gas valve and communication shut-off valve is to be performed.

Furthermore, said hot gas valve is primarily of the type of an electro-magnetic proportional control valve wherein the opening is controlled in proportion with the voltage applied and said communication shut-off valve is in use of either three-way control valve or one on-off controlled stop valve or a plurality of said stop valves.

While said hot gas by-pass passage is to be installed between high pressure gas line and low pressure liquid line, it is recommendable to make said connection with low pressure liquid line at the distributor installed at the in-let side of the evaporator, which results in good mixing of liquid and gas refrigerant.

The above and further objects and novel features of the invention will be more apparent from the following detailed description when the same is read in connection with the accompanying drawings.

DESCRIPTION OF THE PREFERRED EMBODIMENTS

Figure 1:
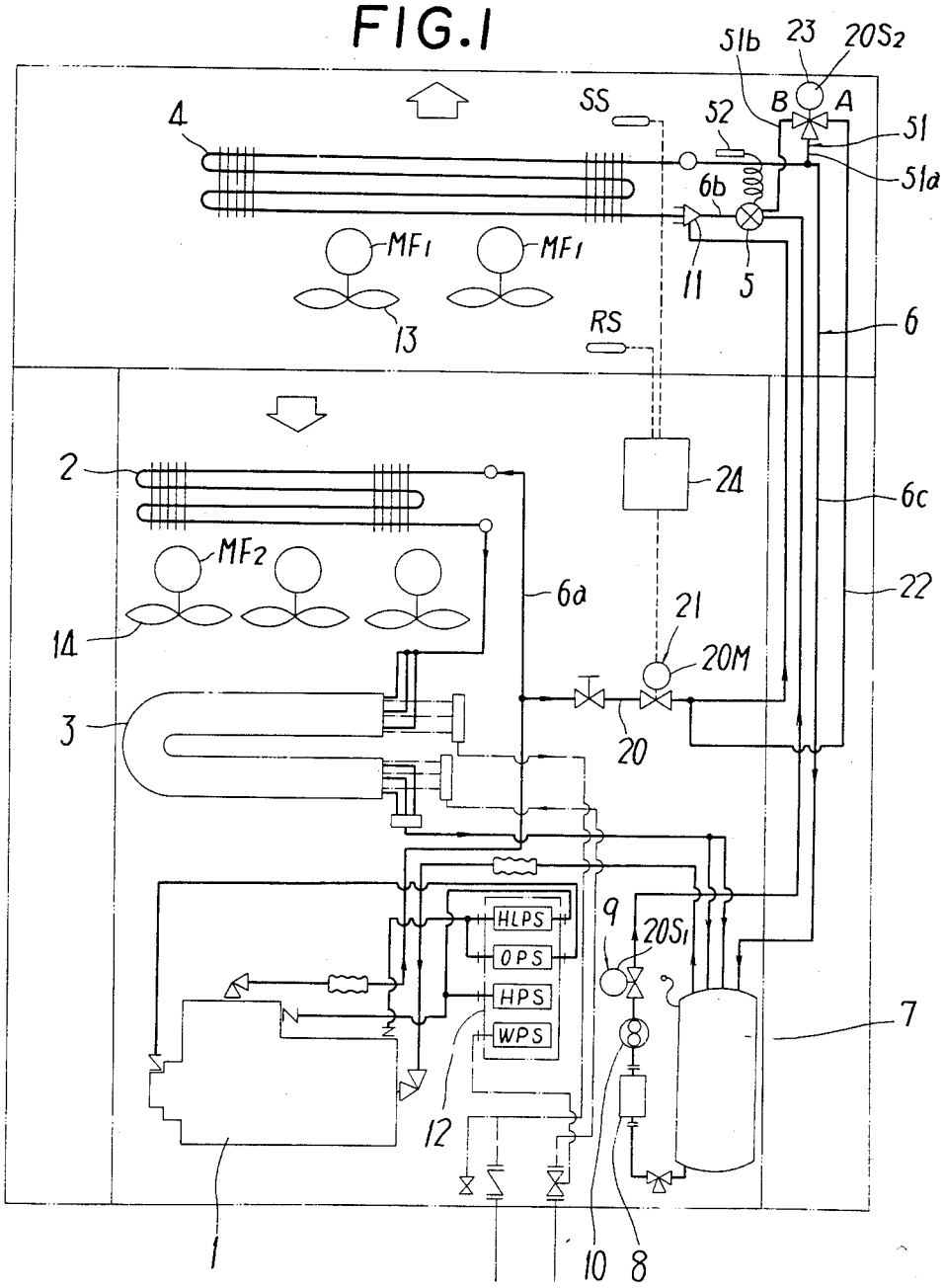
FIG. 1 is a refrigerant piping diagram showing an embodiment of the refrigeration equipment of this invention.

FIG. 1 is a typical embodiment of the refrigeration equipment of this invention, wherein reference numeral 1 designates a compressor, 2 an air-cooled condenser, 3 a water-cooled condenser, 4 an evaporator, 5 a thermostatic expansion valve having an equalizer line 51 and a feeler bulb 52, and 6 designates refrigerant piping interconnecting these elements and constituting a refrigeration circuit to cool the hold air by said evaporator 4.

Moreover, said refrigeration equipment is also equipped with accessories such as accumulator and receiver combined 7, drier 8, solenoid valve for pump-down 9, liquid indicator 10, distributor 11, safety device 12 having a high and low pressure combination switch HLPS, an oil pressure protection switch OPS, a water pressure switch WPS and a high pressure control switch HPS, evaporator fan 13 provided on evaporator 4, and condenser fan 14 provided on said air-cooled condenser 2.

Furthermore, a means of control is incorporated as stated below to control the refrigeration capacity of the refrigeration equipment above constituted. Said means of control consists of a hot gas by-pass passage 20, a hot gas valve 21, a control passage 22 and a communication shut-off valve 23. Said hot gas by-pass passage 20 is provided between high pressure gas line *6a*, connecting the compresser out-let with the air-cooled condenser inlet, and low pressure liquid line, connecting said expansion valve 5 with said evaporator 4, and introduces the hot gas discharged from said compressor 1 directly into said evaporator 4, by-passing said condensers 2, 3, said accumulator and receiver combined 7 and said expansion valve 5. Said hot gas valve 21 is installed on the hot gas by-pass passage 20 and controls the hot gas to be introduced into said evaporator 4. Said control passage 22 is installed on the secondary side of said hot gas valve 21, being connected with the equalizer line 51 of said expansion valve 5 connected to low pressure gas line *6c* and controls the opening of said expansion valve 5 by introducing a portion of hot gas to said equalizer line 51. Said communication shut-off valve 23 is installed at the junction point of said control passage 22 and said equalizer line and shuts off the communication between said hot gas by-pass passage 20 and equalizer line 51 at the close of said hot gas valve 21.

At said hot gas valve 21, a solenoid valve of on-off type may be used but an electro-magnetic proportional control valve is primarily in use because it is able to control the opening over the range of 0%–100% in proportion with the voltage applied, which is to be controlled by a controller 24 as described below.

Moreover, said communication shut-off valve 23 is primarily, as shown in FIG. 1, of the type of three-way solenoid valve wherein said control passage 22 is connected to one of the two switch-over ports thereof, No. 1 equalizer line 51*a* of the equalizer line 51 to the other switch-over port and No. 2 equalizer line 51*b* of the equalizer line 51 to the fixed port, which is to be switched-over between said control passage 22 and No. 1 equalizer line 51*a*.

Figure 2:
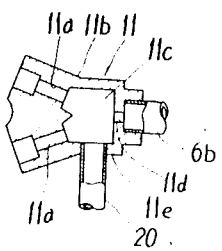
FIG. 2 is an enlarged sectional view of a distributor wherein hot gas by-pass passage is connected.

Furthermore, the out-let side of said hot gas by-pass passage 20 is to be connected, as stated above, to low pressure liquid line 6*b* and although its connection point is not specifically limited, it is recommended to use a distributor 11 shown in FIG. 2 and connect said out-let side to this distributor 11. The distributor 11 is so constructed as to have a mixing chamber 11*c* on the distributor main body 11*b* having a plurality of distribution passages 11*a*, a nozzle port 11*d* at the connection side of said low pressure liquid line 6*b* and a hot gas supply port 11*e* through which hot gas is introduced into said mixing chamber 11*c*.

In this case it is desirable to deviate said supply port 11*e* from the center of said mixing chamber 11*c* and introduce hot gas tangentially into said mixing chamber 11*c*, thus resulting in good mixing of liquid refrigerant passed through said nozzle port 11*d* and hot gas.

Figure 3:
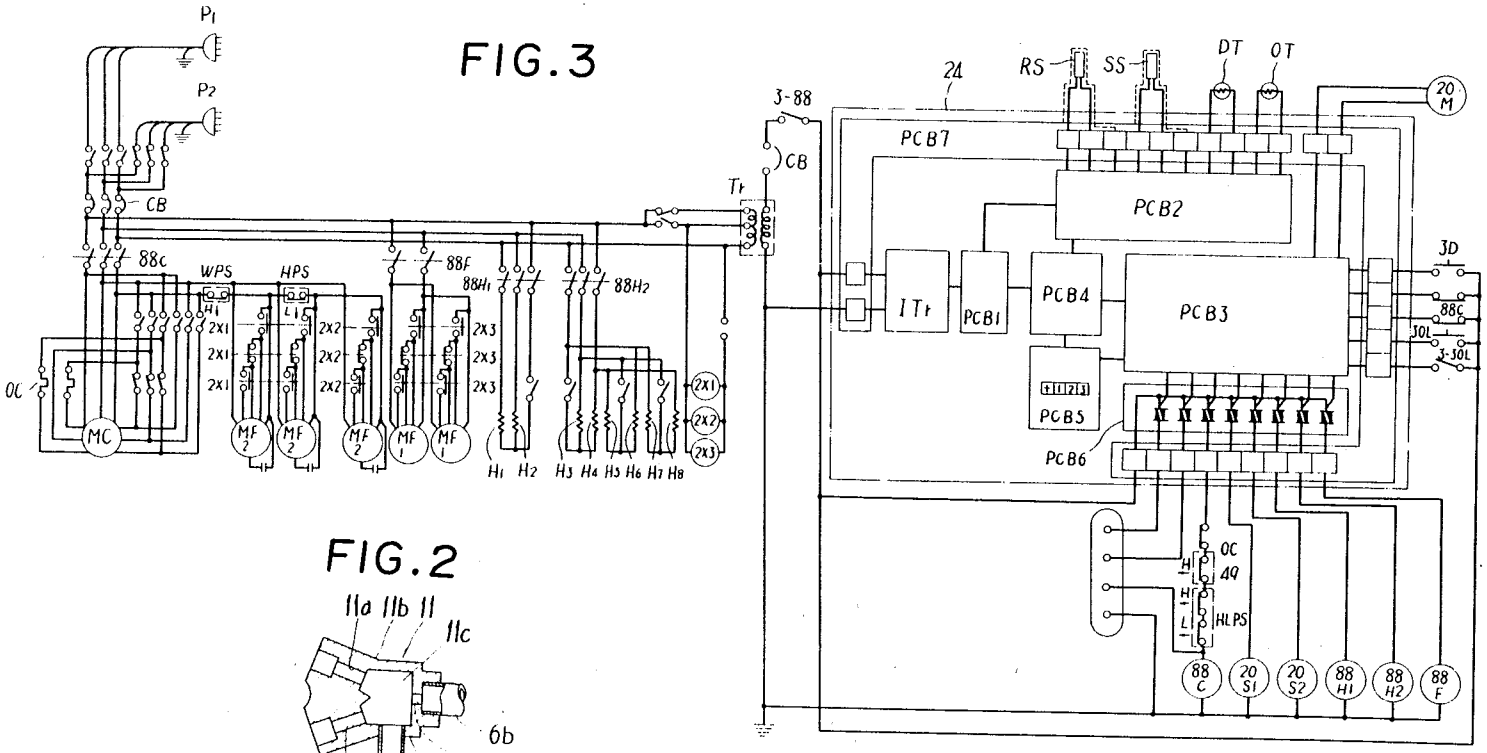
FIG. 3 is an electrical wiring diagram of the refrigeration equipment of this invention.

In the next place, the explanation is given about the controller 24 that controls the supply air temperature at a desired temperature by controlling said hot gas valve 21 and communication shut-off valve 23 and the electrical wiring of said refrigeration equipment incorporating said controller 24, based upon FIG. 3.

Shown in FIG. 3 is an electrical wiring diagram of the refrigeration equipment shown in FIG. 1 wherein provided are one compressor-motor MC, two fan-motors $MF_1$, $MF_1$, for two fans 13, 13 attached to said evaporator 4, three fan-motors $MF_2$, $MF_2$, $MF_2$ for three fans 14, 14, 14 attached to said air-cooled cndenser 4, two defrosting heaters $H_1$, $H_2$ attached to said evaporator 4, four heaters $H_3$ -$H_6$ for heating the hold air and two drain port heaters $H_7$, $H_8$, all of these being connected to power source by selecting either low voltage source plug $P_1$ of 200V or 220V or high voltage source plug $P_2$ of 380V–415V or 440V and said controller 24 and controllers for said motors and heaters being connected to power source through transformer Tr.

Further in FIG. 3, CB is a circuit breaker, OC an overcurrent relay, $2X_1$ -$2X_2$ auxilliary relaies and contacts, 3–88 an on-off switch, contacts with designation code the switch-over contacts by the selection of said plugs $P_1$, $P_2$.

Said controller 24 consists of an in-put transformer ITr, power source in-put unit PCB1, a sensor in-put unit PCB2, an operation in-put and out-put unit PCB3, a central processing unit (hereinafter called as CPU) PCB4, an out-put display and setting in-put unit PCB5 and a relay out-put unit PCB6, wherein relaies of said electrical components, that is, a compressor relay 88C, a solenoid relay $20S_1$ of the pump-down solenoid valve, a solenoid relay $20S_2$ of said communication shut-off valve 23, a heater relay $88H_1$ for said defrost heaters $H_1$, $H_2$, a heater relay $88H_2$ for said hold air heaters $H_3$ -$H_6$ and a fan-motor relay 88F for fan-motors $MF_1$, $MF_1$ are connected, through terminal board PCB7, onto the out-put end of said relay out-put unit PCB6, motorized part 20M of said hot gas valve 21 being connected, through said terminal board PCB7, to the out-put end of said operation in-put and out-put unit PCB3.

As shown in FIG. 1, RS is a return sensor placed on the suction side of said evaporator 4 to sense the temperature of the return air from the hold, that is, the suction air and SS a supply sensor placed on the outlet side of said evaporator 4 to sense the temperature of the supply air, each out-put end being connected to said sensor in-put unit PCB2. DT is a defrost sensor and OT an overheat sensor, each being connected to said sensor in-put unit PCB2.

Besides, 49 is a safety protection device of the compressor consisting of an over-current relay OC and in-series connected high pressure and low pressure combination switch HLPS, said protection device being connected to the in-put end of said compressor relay 88C. 3D is a manual defrost switch, 3QL a reset switch for the oil pressure protection switch explained in FIG. 1 and 3-30L a lamp switch.

In the hook-up above explained, said return sensor RS and supply sensor SS are so arranged that when the temperature setting SETT selected by said setting in-put unit PCB5 is lower than −5° C. for example, said return sensor RS is switched on and when it is higher than 5° C., said supply sensor SS is switched on. When said return sensor RS is switched on, said compressor relay 88C, fan-motor relay 88F and said solenoid relay $20S_1$ are energized and said solenoid relay $20S_2$ deenergized, thus said control passage 22 being closed and the communication between No.1 and No.2 equalizer lines opened and operation of ordinary refrigeration cycle run under the control of suction air temperature.

Figures 4, 5:
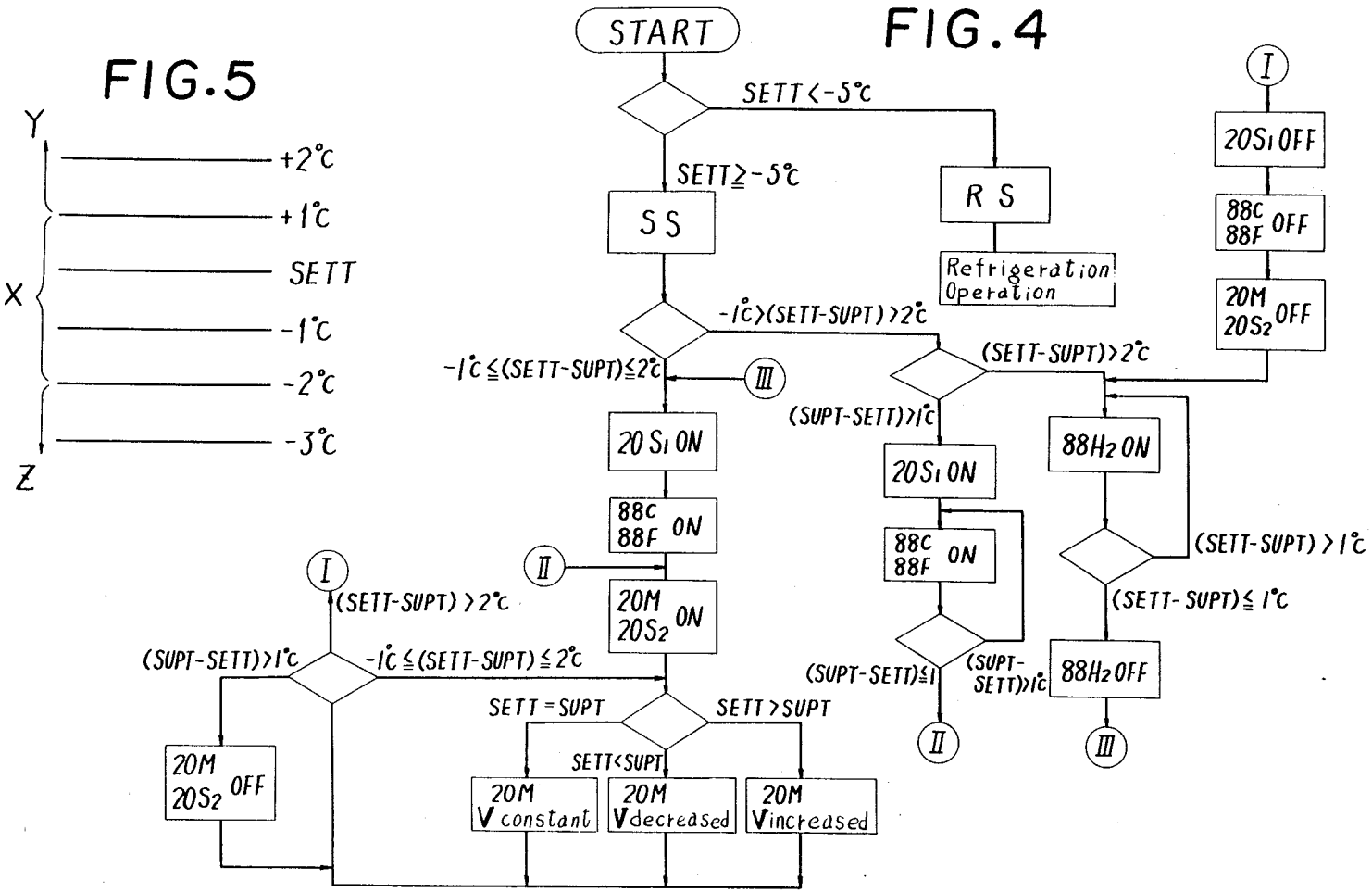
FIG. 4 is a flow chart showing the operation sequence of the refrigeration equipment.
FIG. 5 is an explanatory drawing showing the temperature difference range.

In case that supply sensor SS is switched on, a cold storage operation is run, the sequence of which is explained in accordance with the flow chart shown in FIG. 4.

At the start-up, said solenoid relay $20S_1$ being deenergized, said solenoid valve 9 remains closed, with the circuit held in the pump-down state as a result of the pump-down operation run after the completion of the previous operation.

Under this condition, when a cold storage operation is selected by said setting in-put unit PCB5, the supply sensor SS is switched on and comparison is made by CPU PCB4 between supply air temperature SUPT to be sensed by said sensor SS and temperature setting SETT.

When the temperature difference $\Delta T_1$ between said temperature setting SETT and supply air temperature SUPT lies in the range wherein the condition, $-1° C. \leqq (SETT\text{-}SUPT) \leqq 2° C.$ applies, that is, range X of FIG. 5, said solenoid relay $20S_1$ is energized together with compressor relay 88C and fan-motor relay 88F. And said solenoid relay $20S_2$ is energized, thus communicating said control passage 22 with No.2 equalizer line 51*b* and disconnecting No.1 equalizer line 51*a* and the motorized portion 20M of said hot gas valve 21 is applied with a voltage, which opens said hot gas valve 21 in an opening corresponding to the voltage applied.

At the opening motion of said hot gas valve 21, a portion of hot gas passing through hot gas by-pass passage 20 is introduced, in a flow rate corresponding to said valve opening, into No.2 equalizer line 51*b* of said expansion valve 5 and throttles said expansion valve in an opening corresponding to the pressure of said hot gas.

Therefore, the liquid refrigerant flow rate through said expansion valve 5 decreases in accordance with the valve opening and hot gas of desired flow rate is introduced into evaporator 4 through said distributor 11. Under the condition of reduced capacity by the reduction of the opening of said expansion valve 5, it is possible to provide heating by hot gas and to control the supply air temperature by said hot gas with a high accuracy. Moreover, the control of the opening of said hot gas valve 21 is made by comparison of the temperature between temperature setting SETT and supply air temperature SUPT to be sensed by supply sensor SS. The voltage applied on the motorized portion 20M of said hot gas valve 21 remains constant when both are same and is decreased when supply air temperature SUPT is higher than temperature setting SETT and increased when supply air temperature SUPT is lower.

As a result of hot gas by-pass that controls the valve opening of hot gas valve 21, when said temperature difference $\Delta T_1$ remains within the range above stated, the control of supply air temperature is continued by means of this control system. However, when the temperature difference $\Delta T_2$ between said supply air temperature SUPT and temperature setting SETT comes into the range wherein the condition, (SUPT-SETT)>1° C. applies, that is, Range Y of FIG. 5, solenoid relay 20S$_2$ is deenergized and switches over said communication shut-off valve 23 so as to close the communication between said control passage 22 and No. 2 equalizer line 51*b* and motorized portion 20M of hot gas valve is deenergized, thus switching the operation to that of ordinary refrigeration.

By this operation, if said temperature difference $\Delta T_1$ is reached, the control is switched over to said hot gas control system and while said temperature difference $\Delta T_2$ is retained, said refrigeration operation is needless to say, continued.

When supply air temperature SUPT does not rise even with hot gas by-pass operation and the temperature difference $\Delta T_3$ between supply air temperature SUPT and temperature setting SETT lies in the range wherein the condition, (SETT-SUPT)>2° C. applies, that is, Range Z of FIG. 5, compressor relay 88C, fan-motor relay 88F and said solenoid relay 20S$_1$ are deenergized to stop said compressor 1 and fans 13, 14 and close solenoid valve 9. Said solenoid relay 20S$_2$ is also deenergized to switch over the communication shut-off valve 23, the motorized portion 20M of hot gas valve 21 being deenergized. In this case, the close of said solenoid valve 9 is made for pump-down procedure and has no relationship with the control of operation. And heater relay 88H$_2$ is energized to supply current to hold air heaters $H_3$ -$H_8$.

When said temperature difference $\Delta T_3$ enters, by said current supply to heaters $H_3$ -$H_8$, into the range wherein the condition, (SETT-SUPT)≦1° C. applies, said heater relay 88H$_2$ is deenergized to cut the current supply to said heaters $H_3$ -$H_8$, and as shown by Arrow III, the operation moves to the control system by use of hot gas.

Furthermore, when said temperature difference $\Delta T_3$ lies in the range wherein the condition (SETT-SUPT)>1° C. applies, heating operation by said heaters $H_3$ -$H_8$ is to be continued.

During the cold storage operation by switching-over to said supply sensor SS, the case that the temperature differnece $\Delta T_4$ between said temperature setting SETT and supply air temperature SUPT lies in the range wherein the condition, −1° C.>(SETT-SUPT)>2° C. applies, that is, Range Y +Range Z of FIG. 5 is explained.

In this case, the operation is composed of the control system of Range Y of said temperature difference $\Delta T_2$ and that of Range Z of the temperature difference $\Delta T_3$. When said temperature difference $\Delta T_4$ lies in the range wherein (SUPT-SETT)>1° C. applies, that is, the range of said temperature difference $\Delta T_2$, said solenoid relay 20S$_1$, compressor relay 88C and fan motor relay 88F are energized to drive said compressor 1 and fan motors 13, 14, and an ordinary refrigeration operation is run.

As a result of said refrigeration, when said temperature difference $\Delta T_4$ enters into the range wherein (SUPT-SETT)≦1° C. applies, the operation shifts, as shown by Arrow II, to the operation of the control system by use of hot gas. While said temperature difference $\Delta T_4$ lies in the range wherein (SUPT-SETT)>1° C., said refrigeration operation is continued.

Moreover, when said temperature difference $\Delta T_4$ lies in the range wherein (SETT-SUPT)>2° C. applies, that is, the range of said temperature difference $\Delta T_3$, only said heater relay 88H$_2$ is energized to run heating operation by said hold air heaters $H_3$–$H_8$.

As a result of this heating operation, when said temperature difference $\Delta T_4$ becomes less than 1° C., said heater relay 88H$_2$ is deenergized to disconnect said hold air heaters $H_3$ -$H_8$ and the operation shifts, as shown by Arrow III, to the operation of the control system by use of hot gas, and when the temperature difference $\Delta T_4$ is more than 1° C., the heating operation is continued with the same control as explained in Range Z.

As explained above, when supply air temperature SUPT enters into the range appropriate to temperature setting SETT, that is, said Range X, the control by use of hot gas is made. This control being not only to by-pass hot gas but also to introduce a portion of hot gas, in proportion with the by-pass flow rate, into the equalizing line of said expansion valve 5, thus adjusting the opening of said expansion valve 5, it is possible to provide heating by hot gas while holding the refrigeration capacity at a reduced capacity and control the hold air at a desired temperature regardless of the ambient air temperature and temperature setting and extend the range of control to the domain other than the hatched domain of FIG. 8 and, in addition, reduce the compressor in-put.

In the above explained example of embodiment, said supply sensor SS is used for the opening control of said hot gas valve 21, sensing the supply air temperature and comparing with the temperature setting, but the return sensor RS may be used for this purpose, sensing the suction air temperature. Pressure sensor sensing the low side pressure or high side pressure is also applicable.

Otherwise, it is also applicable to sense the temperature difference between suction air and supply air and control the opening of said hot gas valve in proportion with this temperature difference.

Figure 6:
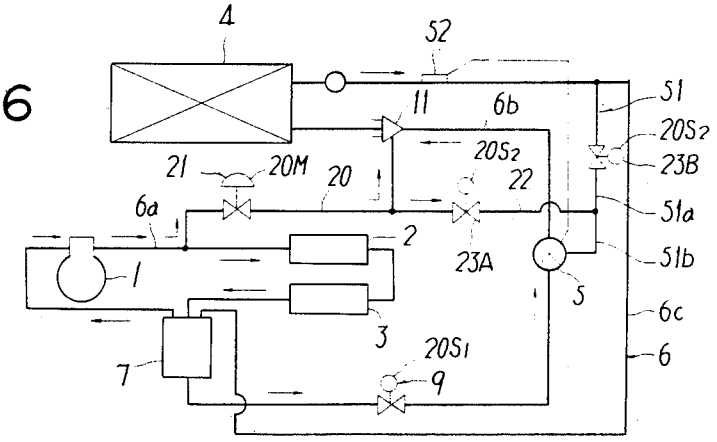
FIGS. 6 through 8 are the refrigerant piping diagrams showing the key points of other embodiments.

Furthermore, while a three-way solenoid valve is used for said communication shut-off valve 23, it is possible to use, as in FIG. 6, two solenoid valves 23A, 23B, each on said control passage 22 and on the equalizer line connecting said control passage 22 and low pressure gas line 6C.

Figure 7:
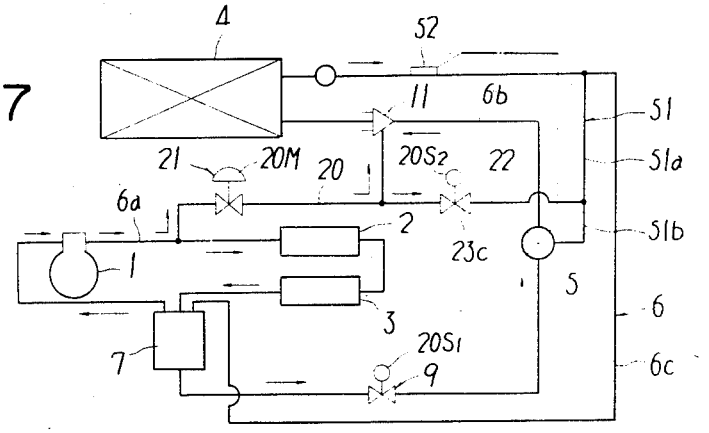

Moreover, as shown in FIG. 7, one solenoid valve 23C may be used, being installed on said control passage 22.

Figure 8:
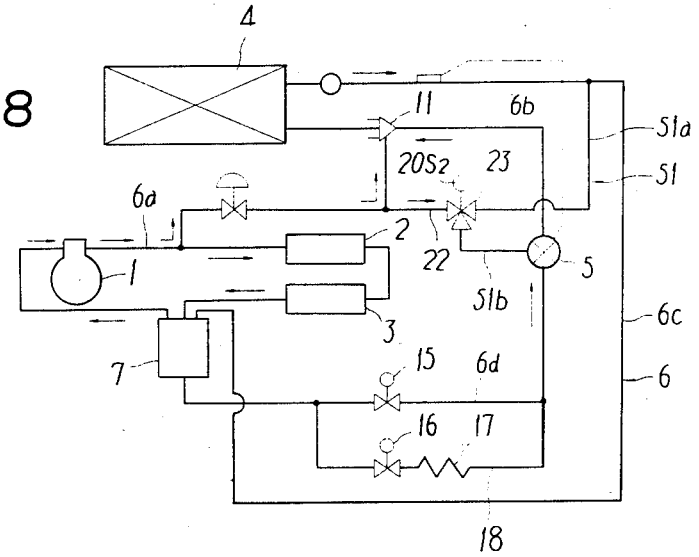

Furthermore, as shown in FIG. 8, No. 1 solenoid valve 15 may be installed on the high pressure liquid line 6*a* connecting said water-cooled condenser 3 with said thermostatic expansion valve 5, or more particularly receiver 7 with thermostatic expansion valve 5, together with a parallel circuit consisting of No. 2 solenoid valve 16 and in-series connected throttling device 17 such as capillary tube.

Because it is possible in this case to control the flow rate of liquid refrigerant by closing No. 1 solenoid valve and opening No. 2 solenoid valve and feeding through said throttling device, a fine control of operation is possible by joint use of hot gas by-pass control.

While, a three-way solenoid valve is used in FIG. 8 as in FIG. 1 for said communication shut-off valve, it is also possible, as shown in FIG. 6 and FIG. 7 to use two solenoid valves 23A, 23B or a solenoid valve 23C in stead of said three-way solenoid valve. No. 1 solenoid valve 15 and No. 2 solenoid valve 16 are also applicalbe to the pump-down operation.

While air-cooled condensor 2 and water-cooled condensor 3 are jointly used as condensers, single condenser 2 or 3 is also applicable. While said equalizer line 51 is connected to the low pressure gas line 6*c*, the connection point thereof is not limited to said low pressure gas line 6*c*, so long as it lies in the low pressure range between the suction side of said compressor 1 and said expansion valve 5.

Figure 9:
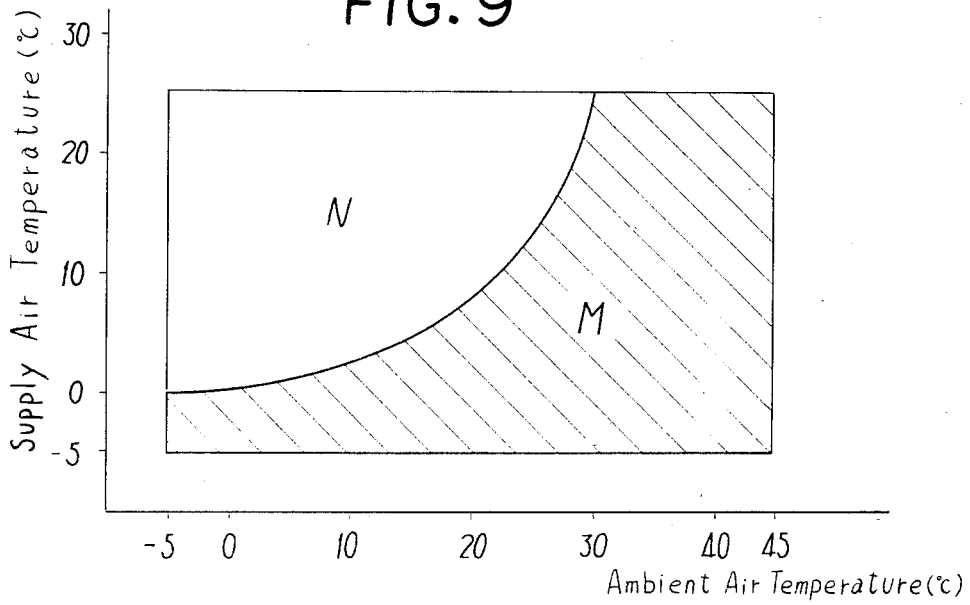
FIG. 9 shows the control characteristics of the supply air temperature relative to ambient air temperature.
Figure 10:
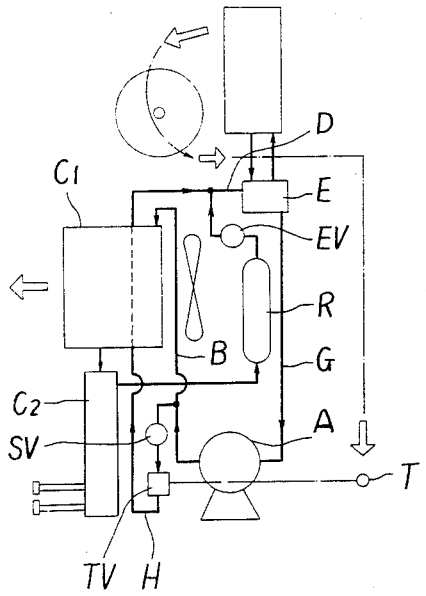
FIG. 10 is a refrigerant piping diagram showing an embodiment of prior art.

Because this invention provides, on the out-let side of said hot gas valve 21 of said hot gas by-pass passage 20, a control passage that connects with the equalizer line 51 of the expansion valve 5 and controls the opening of said expansion valve 5, it is possible to reduce the refrigerant flow through said expansion valve 5, thus improving the accuracy of control by use of hot gas and provide the control of supply air temperature even under a low heat loading such as a high temperature setting or an ambient air temperature lower than the temperature setting. In other words, it is possible, as shown in FIG. 9, to extend the control range of the hold air temperature by use of hot gas in the chilled domain.

Moreover, because the opening of said expansion valve can be controlled during the hot gas by-pass operation, the refrigerant circulation flow rate is reduced, which results in the reduction of compressor in-put and elimination of wasted energy.

As many apparently widely different embodiments of this invention may be made without departing from the spirit and scope thereof, it is to be understood that the invention is not limited to the specific embodiment thereof except as defined in the appended claims.

What is claimed is:

1. In refrigeration equipment having a compressor, a condenser, an evaporator, a thermostatic expansion valve with an equalizer line connected to a low pressure line that connects a suction side of said compressor and an outlet of said expansion valve, said low pressure line also connecting said suction side of said compressor and an outlet of said evaporator, the improvement comprising control means for controlling an opening of said thermostatic expansion valve using pressure from hot gas from said compressor which by passes said condensor and said thermostatic expansion valve, said control means including:

(a) a hot gas by-pass for introducing hot gas discharged from said compressor into said evaporator by by-passing said condensor and said expansion valve;

(b) a hot gas valve on said hot gas by-pass, for controlling an amount of hot gas to be introduced into said evaporator;

(c) a control passage connected on one end to an outlet of said hot gas valve, for introducing a portion of said hot gas discharged from said compressor into said equalizer line to control an opening of said thermostatic expansion valve by means of hot gas pressure, said control passage being connected on another end to said equalizer line; and (d) a communication shut-off valve for shutting off communication between said hot gas by-pass and said equalizer line by means of said control passage, said communication shut-off valve being responsive to closing of said hot gas valve.

2. Refrigeration equipment according to claim 1, wherein said control means includes a controller that controls said hot gas valve and said communication shut-off valve, said controller including sensors to sense at least one of a return air temperature and a supply air temperature from said evaporator, a setting in-put unit to in-put a temperature setting and a central processing unit that compares the temperature setting with at least one of said return air temperature and said supply air temperature, said hot gas valve and said communication shut-off valve each being electrically operable and being on-off controlled by a control signal out-put from said controller.

3. Refrigeration equipment according to claim 2, further comprising electrical heating means, a central processing unit associated with said controller for controlling said heating means and said compressor, and means for stopping operation of said compressor and for initiating operation of said heating means when a temperature difference between the temperature setting and at least one of said return air temperature and said supply air temperature exceeds a predetermine value.

4. Refrigeration equipment according to claim 1, wherein said hot gas valve comprises an electro-magnetic proportional control valve having its opening controlled in proportion with an input voltage applied thereto.

5. Refrigeration equipment according to claim 1, wherein said communication shut-off valve is a three-way solenoid valve positioned at a junction point of said control passage and said equalizer line.

6. Refrigeration equipment according to claim 1, wherein said communication shut-off valve is an on-off solenoid valve positioned on said control passage.

7. Refrigeration equipment according to claim 1, wherein said communication shut-off comprises by two on-off solenoid valves, one of them being positioned on said control passage and the other on said equalizer line.

8. Refrigeration equipment according to claim 1, further comprising a distributor located at an in-let side of said evaporator, said hot gas by-pass line being connected to said distributor.

9. Refrigeration equipment according to claim 1, further comprising a first solenoid valve on a high pressure liquid line connecting said condenser to said thermostatic expansion valve to open or close said high pressure liquid line and second control means for controlling liquid refrigerant flow upon closure of said first solenoid valve through said high pressure liquid line to said thermostatic expansion valve, said second control means including a by-pass passage by-passing said first solenoid valve, a second solenoid valve and a throttling means both being provided on said by-pass passage.

10. Refrigeration equipment according to claim 1, wherein said communication shut-off valve is connected on one end to said control passage and on another end to said equalizer line.

* * * * *